US009308976B2

(12) United States Patent
Peterson

(10) Patent No.: US 9,308,976 B2
(45) Date of Patent: Apr. 12, 2016

(54) MAGNET SYSTEM FOR REMOVABLE ATTACHMENT OF A BAG TO A WATER BOARD

(71) Applicant: Sean Peterson, San Jose, CA (US)

(72) Inventor: Sean Peterson, San Jose, CA (US)

( * ) Notice: Subject to any disclaimer, the term of this patent is extended or adjusted under 35 U.S.C. 154(b) by 0 days.

(21) Appl. No.: 14/815,856

(22) Filed: Jul. 31, 2015

(65) Prior Publication Data

US 2015/0336642 A1 Nov. 26, 2015

Related U.S. Application Data

(63) Continuation-in-part of application No. 13/965,706, filed on Aug. 13, 2013, now Pat. No. 9,126,313.

(51) Int. Cl.

| | |
|---|---|
| ***A45C 3/00*** | (2006.01) |
| ***B63B 35/79*** | (2006.01) |
| ***H01F 7/00*** | (2006.01) |

(52) U.S. Cl.

CPC ..... *B63B 35/7946* (2013.01); *A45C 3/00* (2013.01); *B63B 35/7916* (2013.01); *H01F 7/00* (2013.01); *A45C 2003/007* (2013.01)

(58) Field of Classification Search

CPC ..... B25B 11/002; H01F 7/00
USPC ..... 224/406
See application file for complete search history.

(56) References Cited

U.S. PATENT DOCUMENTS 2,288,105 A * 6/1942 Plotkin ..... A44B 19/34 190/119
3,667,597 A * 6/1972 Hollister ..... A47K 10/32 224/277
4,059,207 A * 11/1977 Jackson ..... A45C 13/00 224/153
4,303,184 A * 12/1981 Kloth ..... B62J 9/008 190/110
4,469,256 A * 9/1984 McEwen ..... B62J 9/008 224/413
4,885,195 A * 12/1989 Change, III ..... A47K 10/12 401/201
5,001,779 A * 3/1991 Eggert ..... B60R 11/02 224/413
5,367,278 A * 11/1994 Yoshikawa ..... H01F 7/0268 206/818
5,516,233 A * 5/1996 Courtney ..... B63C 9/1255 405/186
5,855,454 A * 1/1999 Courtney ..... B63C 9/1055 405/186
5,996,116 A * 12/1999 Tate ..... A01K 97/06 2/12
6,305,590 B1 * 10/2001 Hayes ..... B62J 9/008 190/110
6,401,253 B2 * 6/2002 Brunson ..... A41D 19/01594 2/160
6,558,082 B1 * 5/2003 Courtney ..... B63C 9/1055 116/26
6,666,622 B1 * 12/2003 Courtney ..... B63C 9/08 405/186
8,567,649 B1 * 10/2013 Cabak ..... B60R 7/05 206/459.1
2004/0200868 A1 * 10/2004 Woodman ..... A45C 11/38 224/221
2006/0278675 A1 * 12/2006 Squitieri ..... A45C 3/10 224/581
2007/0199966 A1 * 8/2007 Korchmar ..... A45C 3/06 224/578
2008/0122704 A1 * 5/2008 King ..... H01Q 9/16 343/702
2009/0014105 A1 * 1/2009 Shattuck ..... A45C 11/182 150/147

(Continued)

*Primary Examiner* — Brian D Nash
(74) *Attorney, Agent, or Firm* — Douglas L. Weller

(57) ABSTRACT

A board is configured as a water board. Metal pieces are at least partially embedded in a top surface of the board. Each metal piece is composed of ferrous material. Each metal piece is coated with a water impermeable substance to prevent rusting. The metal pieces are configured to align with magnets located at a bottom of a bag, allowing the bag to be attached to the board by a magnetic bond formed between the magnets and the metal pieces.

14 Claims, 9 Drawing Sheets

(56) References Cited

U.S. PATENT DOCUMENTS

2009/0095751 A1* 4/2009 Hamlin ..... A45C 13/1069
220/230
2011/0233249 A1* 9/2011 Nakajima ..... B62J 99/00
224/545
2012/0023790 A1* 2/2012 Yang ..... D06F 75/40
38/79
2013/0098954 A1* 4/2013 Inglis ..... A45F 5/00
224/148.4
2013/0122761 A1* 5/2013 Macias ..... B63B 35/7933
441/74
2013/0292431 A1* 11/2013 Christian ..... B65D 25/00
224/164

* cited by examiner

MAGNET SYSTEM FOR REMOVABLE ATTACHMENT OF A BAG TO A WATER BOARD

BACKGROUND

Water boards such as surfboards, paddleboards and stand-up paddleboards are used in various water sports and recreation activities. Often one using a water board is on the water for a long period of time. Because water boards often have a flat surface, this limits storage options for accessories such as water bottles and smart phones. This is especially true when water surface is uneven because of the presence of waves.

DETAILED DESCRIPTION OF THE EMBODIMENTS

Figure 1:
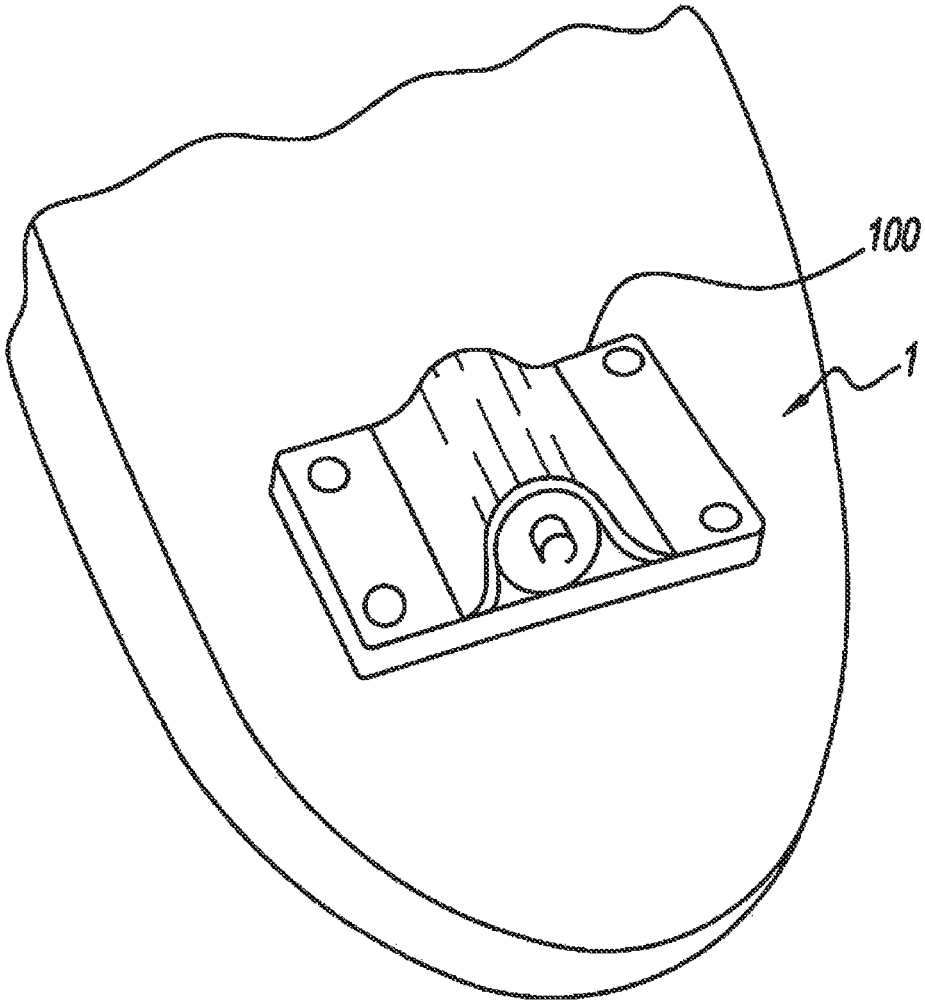
FIG. 1 is a perspective view of a bag removably secured to a water board with a magnet system for bag attachment in accordance with an embodiment.

In accordance with various implementations, a board is configured as a water board. Metal pieces are at least partially embedded in a top surface of the board. Each metal piece is composed of ferrous material. Each metal piece is coated with a water impermeable substance to prevent rusting. The metal pieces are configured to align with magnets located at a bottom of a bag, allowing the bag to be attached to the board by a magnetic bond formed between the magnets and the metal pieces.

For example, the each metal piece is embedded in a bore within the board so that a surface of the board is smooth at a location where the metal pieces are embedded within the board. For example, the metal pieces are metal disks.

In another implementation, a water board bag has mounting material. A plurality of magnets is mounted so as to locate the plurality of magnets over metal pieces mounted on a water board. Each magnet in the plurality of magnets generates a magnetic bond to the plurality of metal pieces of sufficient strength to hold the water board bag to the water board. Waterproof material encompasses the mounting material and the plurality of magnets. The waterproof material protects the mounting material and the plurality of magnets from moisture when the water board bag is mounted on the water board. A waterproof pouch is connected to the waterproof material. The waterproof pouch protects contents of the waterproof pouch from moisture when the water board bag is mounted on the water board.

For example, the waterproof pouch is sized to contain a small electronic device such as a smart phone or a global positioning system (GPS) device. For example, the water board bag additionally includes a bottle sleeve attached to the waterproof pouch.

For example, the waterproof pouch is configured as part of a tackle bag. The tackle bag is configured to hold fishing tackle. For example, the tackle bag is connected to the waterproof material using a radio frequency welded hinge that allows the tackle bag to be in an open position or a closed position. For example, the tackle bag includes mounting material having cut-out sections. A plurality of metal parts is located in the cut-out sections of the mounting material. The cut-out sections are configured to locate the plurality of metal parts over the plurality of magnets when the tackle bag is in the closed position. The magnetic bond between the plurality of metal parts and the plurality of magnets hold the tackle bag in the closed position.

In another implementation, a water board bag comprises waterproof material. A plurality of magnets is mounted in the waterproof material. The mounting of the plurality of magnets within the waterproof material sections is configured to locate the plurality of magnets over metal pieces mounted on a water board. Each magnet in the plurality of magnets generates a magnetic bond to the plurality of metal pieces of sufficient strength to hold the water board bag to the water board. The waterproof material protects the plurality of magnets from moisture when the water board bag is mounted on the water board. A tackle bag is configured to hold fishing tackle. The tackle bag is connected to the waterproof material using a hinge that allows the tackle bag to be in an open position or a closed position.

For example, the hinge is a radio frequency welded hinge. For example, the tackle bag comprises mounting material having cut-out sections. A plurality of metal parts is located in the cut-out sections of the mounting material. The cut-out sections are configured to locate the plurality of metal parts over the plurality of magnets when the tackle bag is in the closed position. The magnetic bond between the plurality of metal parts and the plurality of magnets holds the tackle bag in the closed position. For example, the plurality of magnets are mounted in the waterproof material using mounting material having cut-out sections.

Figure 2:
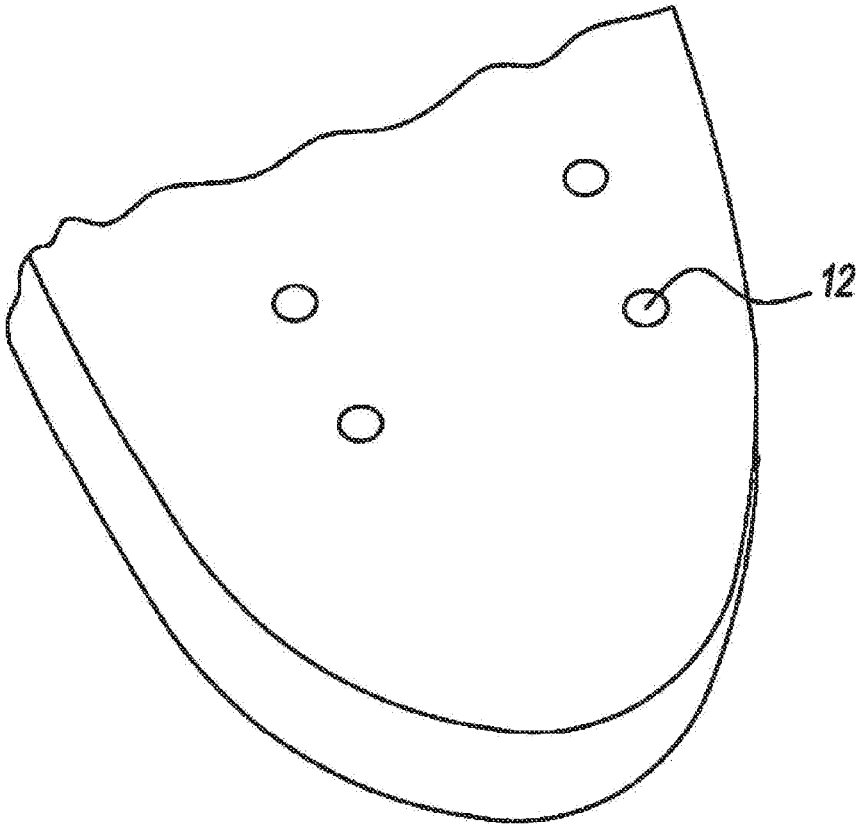
FIG. 2 is a perspective view of a water board with four metal discs retained thereupon of a magnet system for bag attachment in accordance with an embodiment.
Figure 3A:
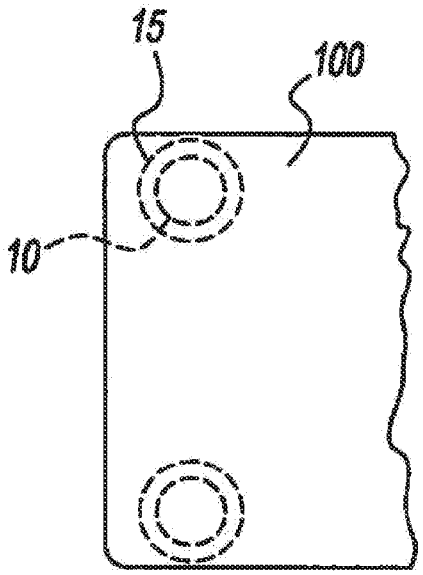
FIG. 3A is a bottom view of a left portion of a bag with two magnets retained therein of a magnet system for bag attachment in accordance with the present invention.
Figure 3B:
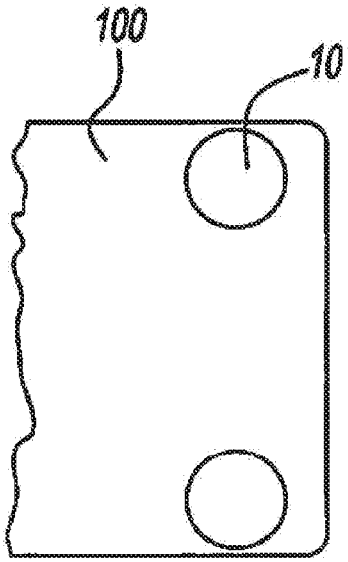
FIG. 3B is a bottom view of a right portion of a bag with two magnets retained thereon of a magnet system for bag attachment in accordance with an embodiment.
Figure 4:
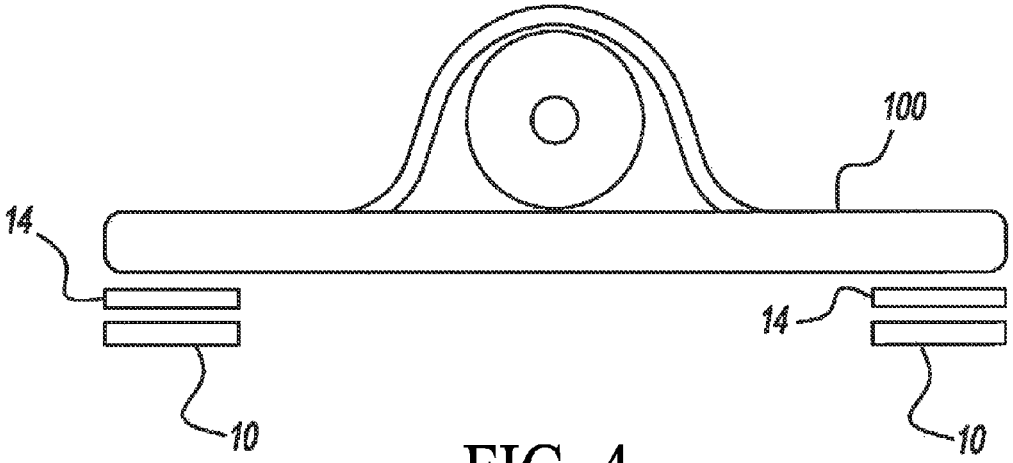
FIG. 4 is a partially exploded end view of a bag with at least one magnet and a securing device of a magnet system for bag attachment in accordance with an embodiment.
Figure 5:
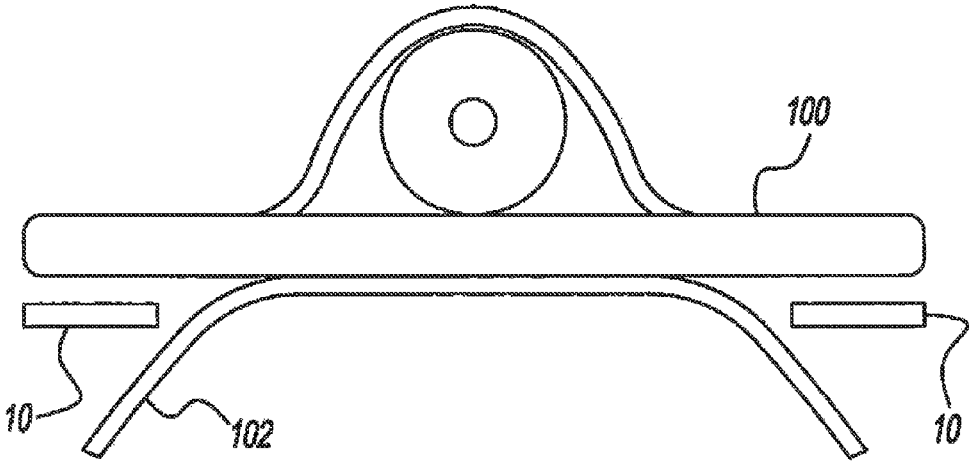
FIG. 5 is a partially exploded end view of a bag with at least one magnet of a magnet system for bag attachment in accordance with an embodiment.

With reference now to the drawings, and particularly to FIG. 1, there is shown a perspective view of a magnet system for bag attachment 1. With reference to FIGS. 2-3*b*, the magnet system for bag attachment 1 preferably includes at least one magnet 10 and at least one metal disc 12. The at least one magnet 10 is retained in or on a bottom of a bag 100. With reference to FIGS. 4-5, the at least one magnet 10 is preferably retained in a bottom wall 102 of the bag 100; attached to the bag 100 with a piece of double sided tape 14; or attached with any other suitable attachment method. The at least one magnet 10 may be retained in a bottom of the bag 100 by retaining the at least one magnet 10 between two pieces of material in the bottom wall 102 and around at least a portion of the perimeter of the at least one magnet 10. The at least one metal disc 12 must fabricated of a ferrous material, such as steel.

Figure 6:
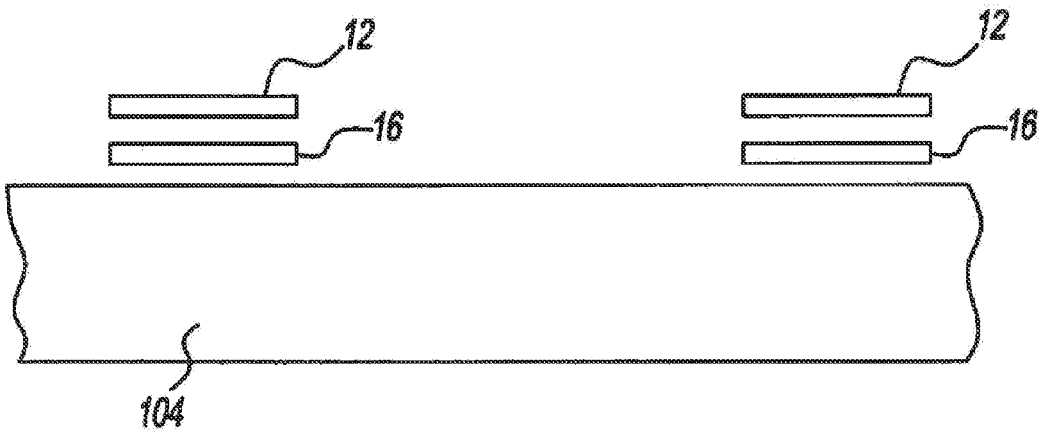
FIG. 6 is a partially exploded end view of a water board with at least one magnet and a securing device of a magnet system for bag attachment in accordance with an embodiment.
Figure 7:
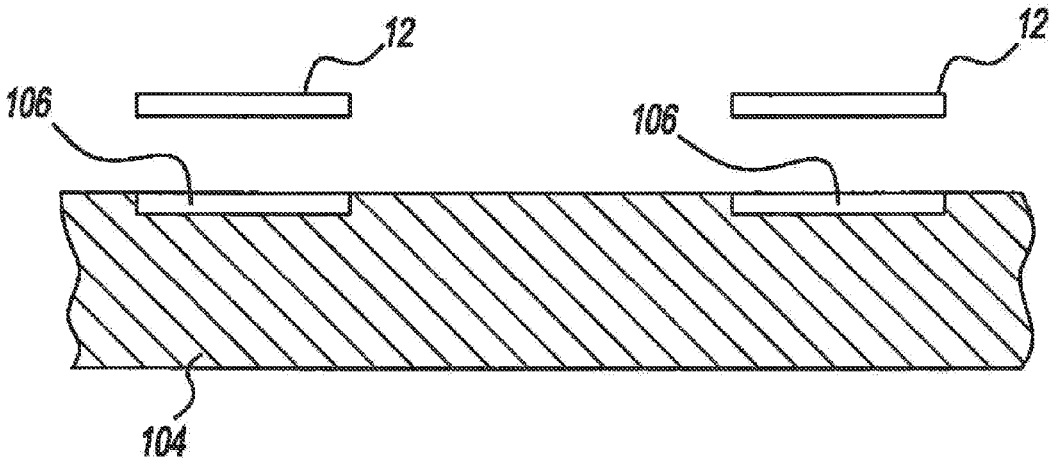
FIG. 7 is a partially exploded cross sectional end view of a water board with at least one magnet of a magnet system for bag attachment in accordance with an embodiment.

With reference to FIGS. 6 and 7, the at least one metal disc 12 is coated with a water impermeable substance to prevent rusting. The at least one metal disc 12 is retained on a surface of a water board 104. The at least one metal disc 12 may be attached to a water board 104 with a piece of double sided tape 16, pressed into a bore 106 formed in the water board 104, or secured to the water board 104 with any other suitable method. The bag 100 will be removably retained relative to the water board 104, when a magnetic field of the at least one magnet 10 is in contact with the at least one metal disc 12.

Figure 8:
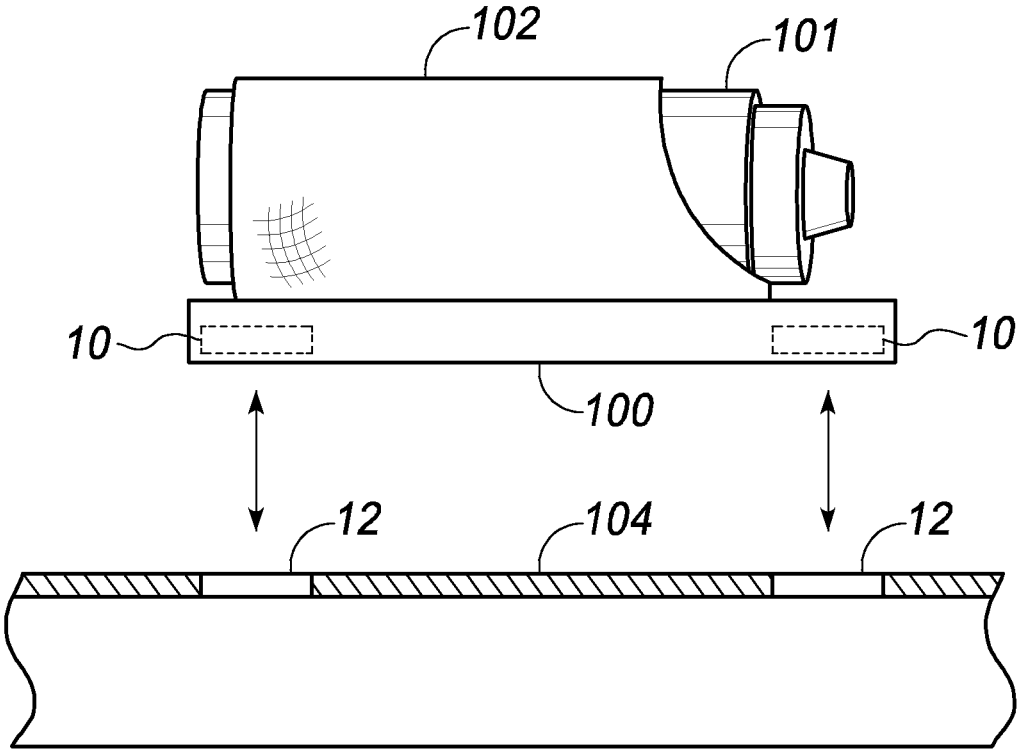
FIG. 8 is illustrates a bag ready to be attached to a water board in accordance with an embodiment.

FIG. 8 shows metal discs 12 embedded in water board 104. A water bottle 101 is stored within a bottle sleeve 102.

Figure 9:
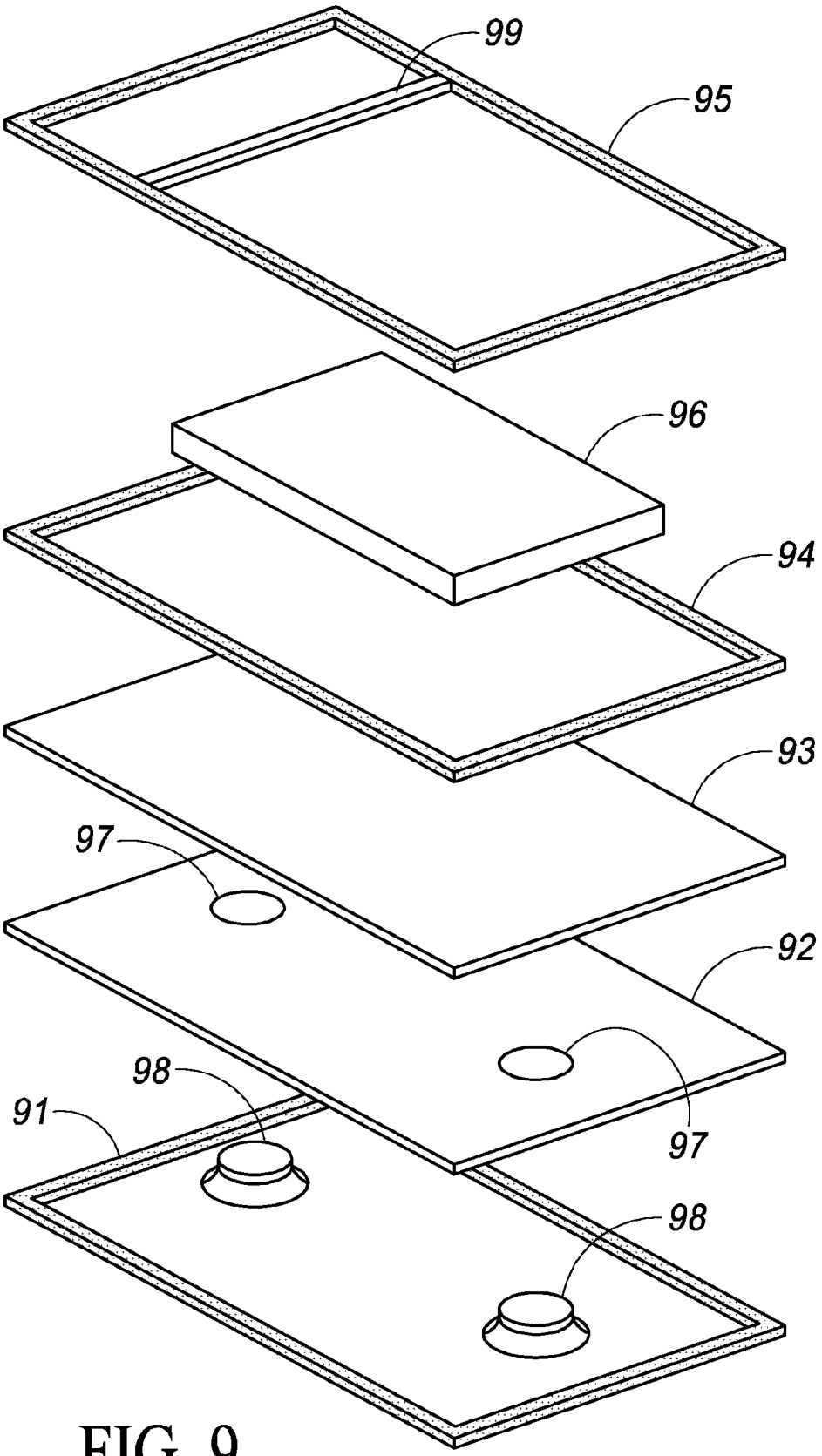
FIG. 9 shows an exploded view of an embodiment of a bag ready to hold and protect an electronic device in accordance with an embodiment.

FIG. 9 shows an exploded view of an embodiment of a bag ready to hold and protect an electronic device, such as a smart phone, a global positioning system (GPS) device or a tablet computer. A waterproof layer 91 will come into contact with the water board. Magnet pouches 98 are RF welded to waterproof layer 91. Magnet pouches 98 are used to hold magnets in place against waterproof layer 91 and to protect the magnets from moisture. When assembled, magnet pouches 98 are within holes 97 of mounting material 92. For example, mounting material 92 is a one-quarter inch thick foam layer. Alternatively, mounting material 92 may be incorporated into waterproof layer 91.

For example, a layer 93 is placed over mounting material 92. For example, layer 93 is a one-quarter inch thick foam layer. A waterproof layer 94 is placed over layer 93. For example, edges of waterproof layer 91 are sealed with edges of layer 94 to form waterproof material that protects magnet pouches 98, mounting material 92 and layer 93 protected from moisture. For example, the seal is accomplished using radio frequency (RF) heat sealing.

A waterproof layer 95 is placed over layer 94. For example, edges of layer 95 are sealed with edges of layer 94 to form a water proof pouch area in which contents may be stored that are protected from moisture. For example, the seal is accomplished using radio frequency (RF) heat sealing. An electronic device 96 can be stored in the pouch area between layers 94 and 95. A zipper 99 or other waterproof fastener is used to allow electronic device 96 to be placed in and removed from the pouch area. For example, layer 95 is clear plastic allowing electronic device 96 to be viewed while within the pouch area. For example, electronic device 96 is a smart phone, GPS device, tablet computer or other electronic device.

Figure 10:
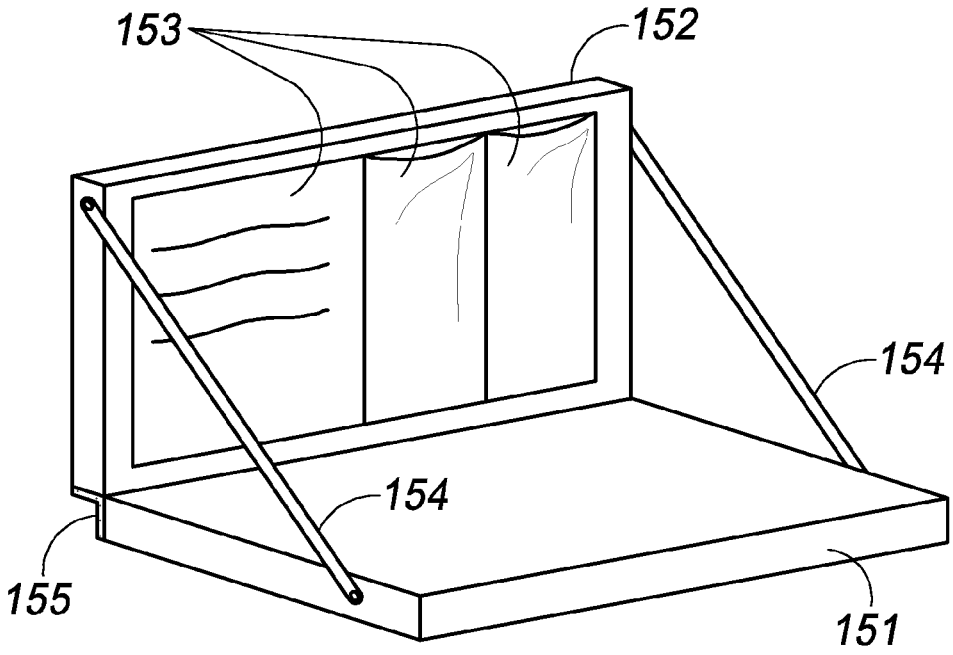
FIG. 10 shows an embodiment of a storage bag in an open position ready to hold fishing tackle in accordance with an embodiment.

FIG. 10 shows an embodiment of a storage bag configured for fishing tackle. A top portion 152 is attached to a bottom portion 151 via a hinge 155. For example, hinge 155 is accomplished using a dielectric seal accomplished via radio frequency (RF) heat sealing. Straps 154 can be used to limit the range of motion between top portion 152 and bottom portion 151. Various pouches 153 (waterproof and otherwise) are organized within top portion 152 to allow storage of fishing tackle.

Figure 11:
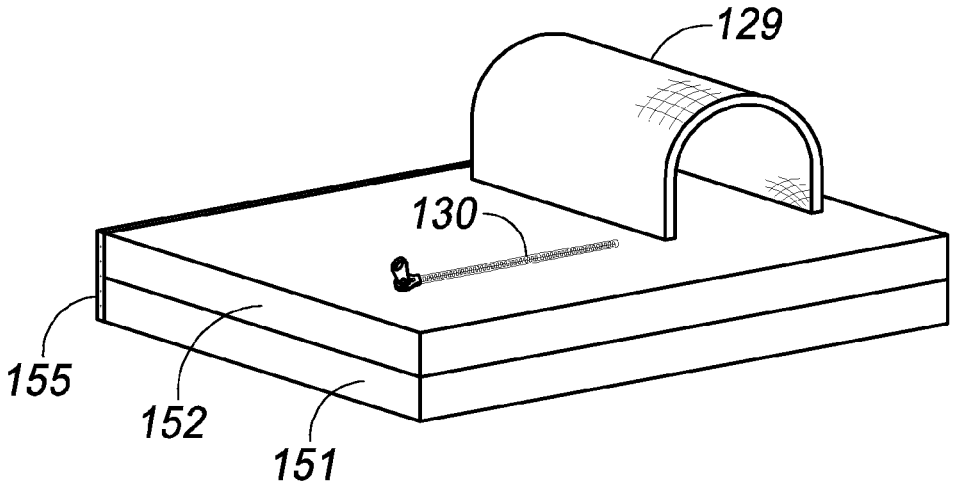
FIG. 11 shows the storage bag of FIG. 10 shown in a closed position in accordance with an embodiment.

FIG. 11 shows top portion 152 shut against bottom portion 151. Top portion 152 is shown to include an outside pouch accessible via a zipper 130. A bottle sleeve 129 is located conveniently to hold a water bottle or other container.

Figure 12:
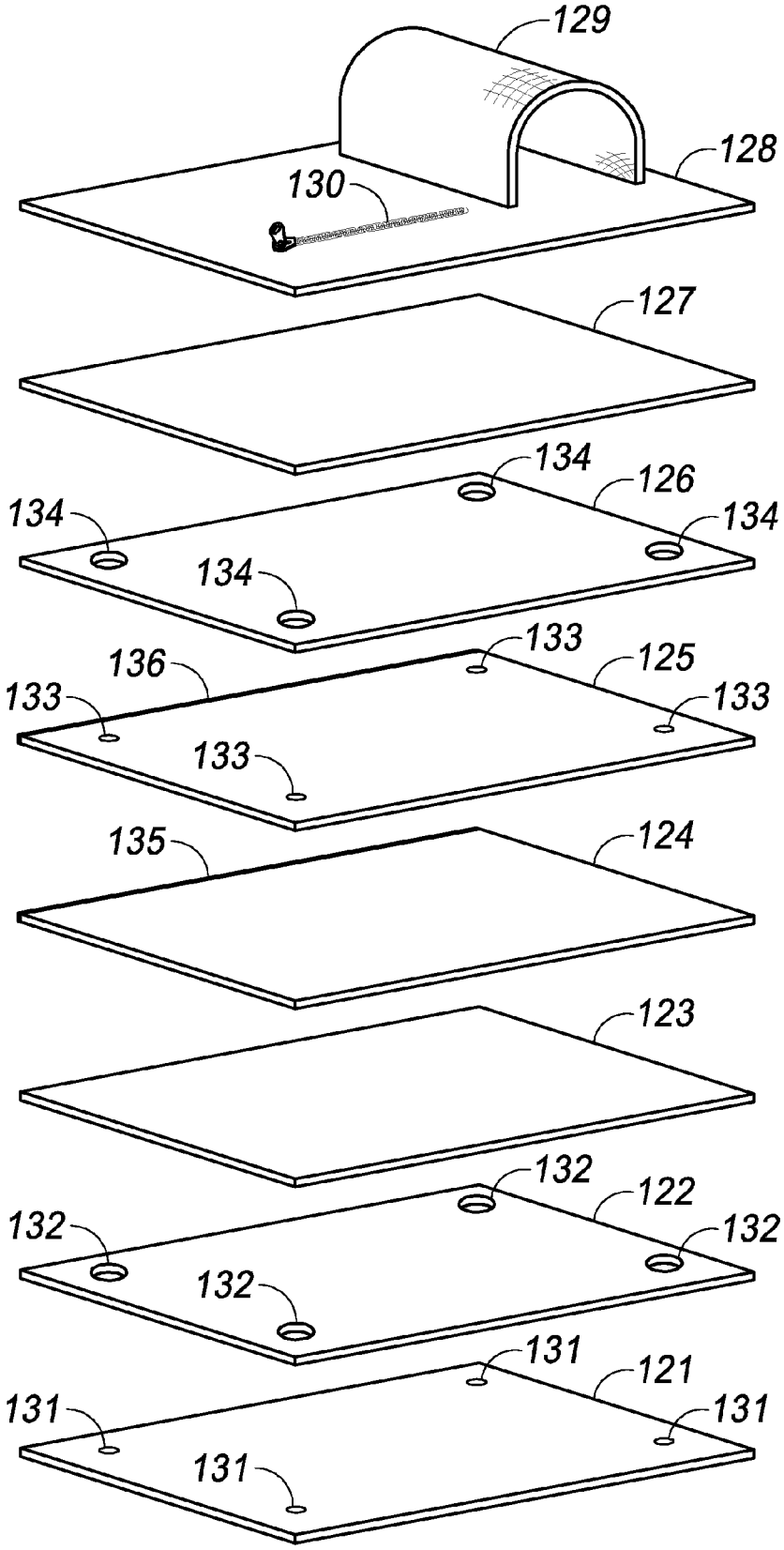
FIG. 12 shows an exploded view of the storage bag shown in FIG. 10 in accordance with an embodiment.

FIG. 12 shows an exploded view of the storage bag shown in FIG. 10 and FIG. 11. A waterproof layer 121 will come into contact with the water board. Magnets 131 are located on layer 121 and within cut out holes 132 of layer 122. For example layer 122 is a one-quarter inch thick foam layer. For example, a layer 123 is placed over layer 122. For example, layer 123 is a one-quarter inch thick foam layer. A waterproof layer 124 is placed over layer 123. For example, edges of layer 121 are sealed with edges of layer 124 to keep layers 122 and 123 protected from moisture. For example, the seal is accomplished using radio frequency (RF) heat sealing. Layers 121 through 124 together form bottom portion 151 of the storage bag configured for fishing tackle.

A waterproof layer 125 is placed over layer 124. Hinge 155 (shown in FIGS. 10 and 11) is formed at an intersection of edge 135 of layer 124, and edge 136 of layer 125.

Figure 13:
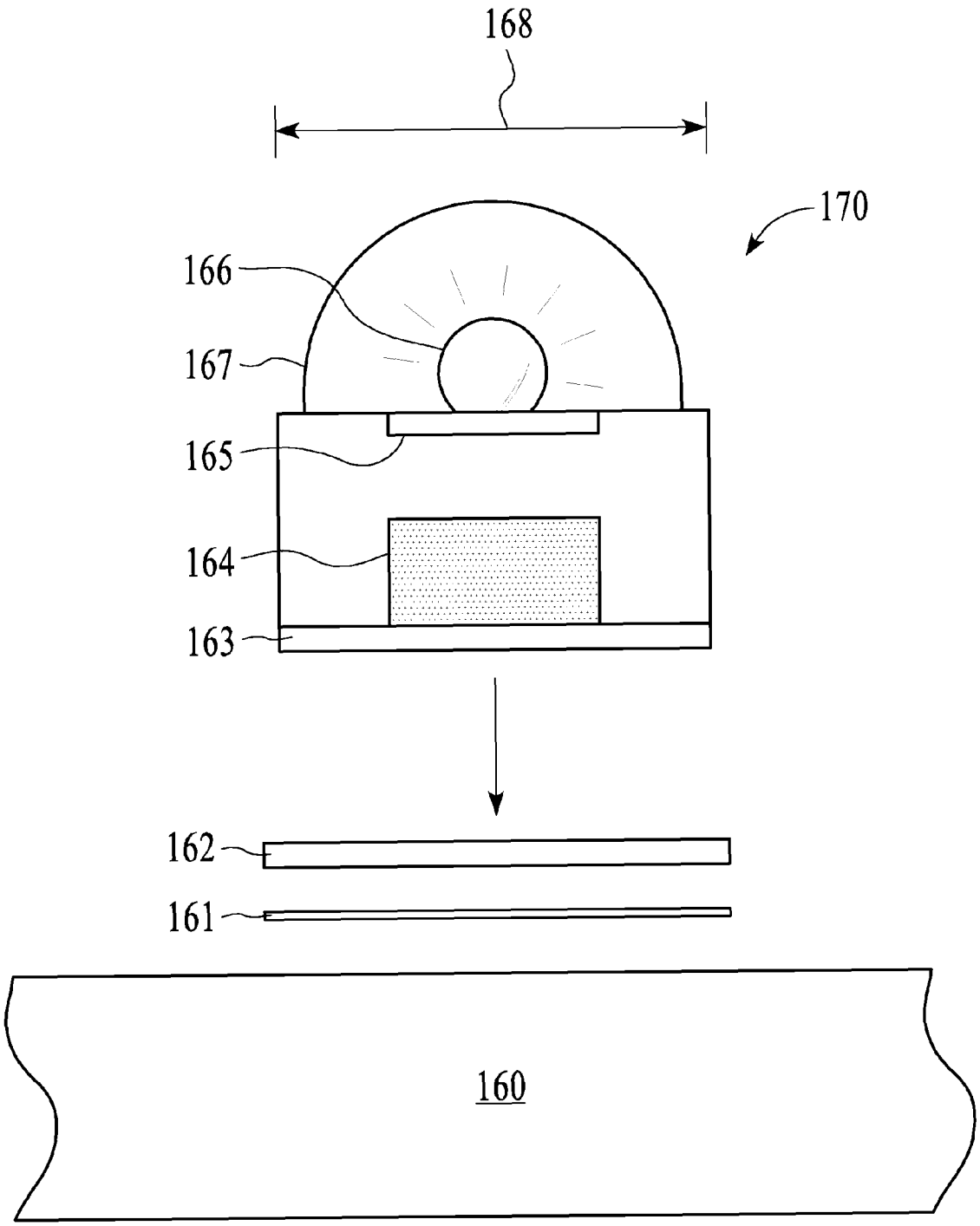
FIG. 13 illustrates attaching a light to a waterboard in accordance with an embodiment.

FIG. 13 illustrates attaching a lighting device 170 to a waterboard 160. A metal disc 162 is attached to a water board 160 with a piece of double sided tape 161 or other adhesive. Alternatively, metal disc 162 is embedded in waterboard 160, for example by being pressed into a bore formed in water board 162 is or secured to the water board 160 with any other suitable method. Lighting device 170 will be removably retained relative to water board 162, when a magnetic field of a magnet 164 is in magnetic contact with metal disk 162. For example, a water tight cap 163 is over magnet 164 to protect magnet 164 from moisture etc. A light 166 is powered by a battery 165. For example light 166 is an LED light or a light made from another suitable technology. LED may be of any desired color and magnitude. A cover 167 protects light 166 from moisture etc. For example, a diameter 168 of light 170 is approximately two inches.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A water board comprising:

a board configured as a water board; and, a plurality of metal pieces at least partially embedded in a top surface of the board, each metal piece in the plurality of metal pieces being composed of ferrous material, and each metal piece being coated with a water impermeable substance to prevent rusting;

wherein the plurality of metal pieces are configured on the top surface of the board to allow the metal pieces to form magnetic bonds, so that when a plurality of magnets located at a bottom of a bag is placed on the top surface of the board, a magnetic bond can be formed between the plurality of magnets and the plurality of metal pieces sufficient to hold the bag to the top surface of the board.

2. A water board as in claim 1 wherein each of the metal pieces are embedded in a bore within the board so that a surface of the board is smooth at a location where the metal pieces are embedded within the board.

3. A water board as in claim 1 wherein the metal pieces are metal disks.

4. A water board bag comprising:

mounting material having cut-out sections;

a plurality of magnets mounted on the mounting material so as to locate the plurality of magnets at a bottom of the water board bag so that when the water board bag is placed over metal pieces mounted on a water board, each magnet in the plurality of magnets can generate a magnetic bond with one of the plurality of metal pieces of sufficient strength to hold the water board bag to the water board;

waterproof material that encompasses the mounting material and the plurality of magnets, the waterproof material protecting the mounting material and the plurality of magnets from moisture when the water board bag is mounted on the water board; and, a waterproof pouch connected to the waterproof material, the waterproof pouching protecting contents of the waterproof pouch from moisture when the water board bag is mounted on the water board.

5. A water board bag as in claim 4 wherein the waterproof pouch is sized to contain a small electronic device such as a smart phone or a global positioning system (GPS) device.

6. A water board bag as in claim 4 wherein the waterproof pouch is sized to contain a smart phone.

7. A water board bag as in claim 4 additionally comprising a bottle sleeve attached to the waterproof pouch.

8. A water board bag as in claim 4 wherein the waterproof pouch is configured as part of a tackle bag, configured to hold fishing tackle.

9. A water board bag as in claim 8 wherein the tackle bag is connected to the waterproof material using a radio frequency welded hinge that allows the tackle bag to be in an open position or a closed position.

10. A water board bag as in claim 9 wherein the tackle bag comprises:

mounting material having cut-out sections; and, a plurality of metal parts located in the cut-out sections of the mounting material, the cut-out sections being configured to locate the plurality of metal parts over the plurality of magnets when the tackle bag is in the closed position, the magnetic bond between the plurality of metal parts and the plurality of magnets holding the tackle bag in the closed position.

11. A water board bag comprising:

waterproof material;

a plurality of magnets mounted in the waterproof material, mounting of the plurality of magnets within the waterproof material sections being configured to locate the plurality of magnets at a bottom of the water board bag so that when the water board bag is placed over metal pieces mounted on a water board, each magnet in the plurality of magnets can generate a magnetic bond with one of the plurality of metal pieces of sufficient strength to hold the water board bag to the water board, the waterproof material protecting the plurality of magnets from moisture when the water board bag is mounted on the water board; and, a tackle bag configured to hold fishing tackle, the tackle bag being connected to the waterproof material using a hinge that allows the tackle bag to be in an open position or a closed position.

12. A water board bag as in claim 8 wherein the hinge is a radio frequency welded hinge.

13. A water board bag as in claim 11 wherein the tackle bag comprises:

mounting material having cut-out sections; and, a plurality of metal parts located in the cut-out sections of the mounting material, the cut-out sections being configured to locate the plurality of metal parts over the plurality of magnets when the tackle bag is in the closed position, the magnetic bond between the plurality of metal parts and the plurality of magnets holding the tackle bag in the closed position.

14. A water board bag as in claim 11 wherein the plurality of magnets are mounted in the waterproof material using mounting material having cut-out sections.

* * * * *